United States Patent [19]

Suzuki

[11] Patent Number: 4,646,614

[45] Date of Patent: Mar. 3, 1987

[54] SOUND BAR TYPE PERCUSSIVE MUSICAL INSTRUMENT

[75] Inventor: Shigeo Suzuki, Hamamatsu, Japan

[73] Assignee: Nippon Ga-Ki Seizo Kabushiki Kaisha, Japan

[21] Appl. No.: 791,777

[22] Filed: Oct. 28, 1985

[30] Foreign Application Priority Data

Nov. 9, 1984 [JP] Japan ..... 59-169182

[51] Int. Cl.[4] ..... G10D 13/08

[52] U.S. Cl. ..... 84/403; 84/410

[58] Field of Search ..... 84/402–405, 84/410

[56] References Cited

U.S. PATENT DOCUMENTS 2,021,080 11/1935 Musser ..... 84/410

*Primary Examiner*—Lawrence R. Franklin

*Attorney, Agent, or Firm*—Lerner, David, Littenberg, Krumholz & Mentlik

[57] ABSTRACT

In construction of a sound bar type percussive musical instrument, the center sections of tube holders are firmly coupled to the center sections of the front and rear walls of the base frame in order to block the tube holders against undesirable center flexion due to weight of resonator tubes, thereby assuring uniform gaps for all sound bars and resonator tubes.

4 Claims, 6 Drawing Figures

SOUND BAR TYPE PERCUSSIVE MUSICAL INSTRUMENT

BACKGROUND OF THE INVENTION

The present invention relates to an improved sound bar type percussive musical instrument, and more particularly relates to an improvement in the holding structure of resonator tubes on a sound bar type percussive musical instrument such as a marimba.

In construction of a sound bar type percussive musical instrument such as a marimba and a xylophone, a number of sound bars, each tuned to a prescribed resonance frequency, are arranged side by side in the order of tonal pitch on a horizontal, rectangular base frame and each sound bar is associated with a resonator tube arranged below. When a sound bar is beaten with a mallet, a sound generated is increased in tone volume by resonance of an associated resonator tube. Such resonance is employed in order to enrich sounds in particular in the bass range, thereby enlarging the total tone range.

A line of resonator tubes are sandwiched by a pair of tube holders which extend laterally on a base frame. Each tube holder is detachably coupled at both ends to side walls of the base frame. Such a holding structure has a demerit that the middle section of the tube holder flexes downwards due to weight of the resonator tubes it holds. In order to reduce such flexion, it is proposed to form the tube holders from aluminium or the like. However, use of such a material cannot fully avoid undesirable flexion of the tube holders in particular when the number of resonator tubes is increased on a large size musical instrument. Such center flexion causes inter-tube variation in the gap between a sound bar and an associated resonator tube. In addition, such flexion induces vertical vibration of the tube holders which amplifies the above-described inter-tube variation in the gap. Presence of uneven gaps seriously mars resonance characteristics of the resonator tubes, thereby posing malign influence on tone quality.

SUMMARY OF THE INVENTION

It is the object of the present invention to fully avoid center flexion of tube holders on a sound bar type percussive musical instrument in order to well maintain intended resonance characteristics of resonator tubes.

In accordance with the present invention, the center sections of tube holders are firmly coupled to the center sections of the front and rear walls of the base frame of a sound bar type percussive musical instrument.

DESCRIPTION OF THE PREFERRED EMBODIMENTS

Figure 1:
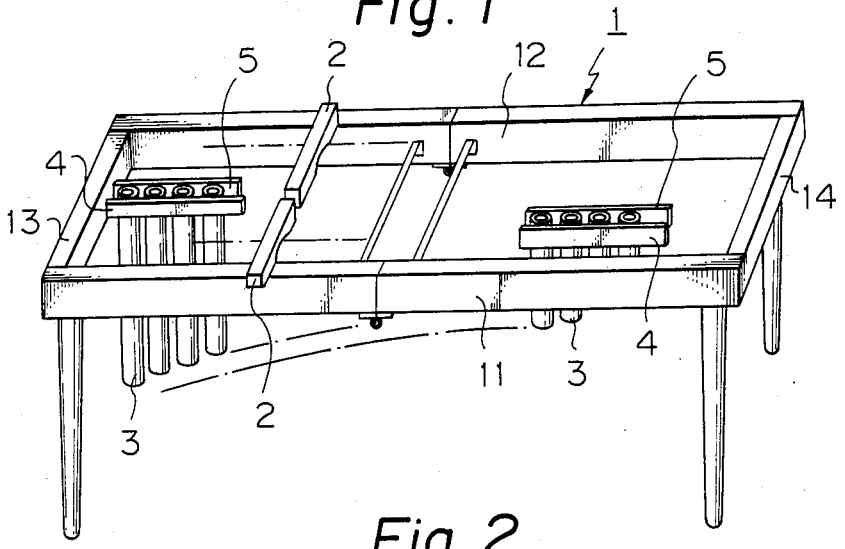
FIG. 1 is a whole perspective view of a typical sound bar type percussive musical instrument to which the present invention is advantageously applicable.

In FIG. 1, a sound bar type percussive musical instrument includes a horizontal, rectangular base frame 1 which is made up of a front wall 11, a rear wall 12 and a pair of side walls 13 and 14 fixed to each other at their ends. A number of sound bars 2 are mounted side by side to the base frame 1 in the order of tonal pitch. Each sound bar 2 is associated with a resonator tube 3 held below by a pair of tube holders 4 and 5. The tube holders 4 and 5 are detachably coupled at their ends to the side walls 13 and 14 of the base frame 1.

Figure 2:
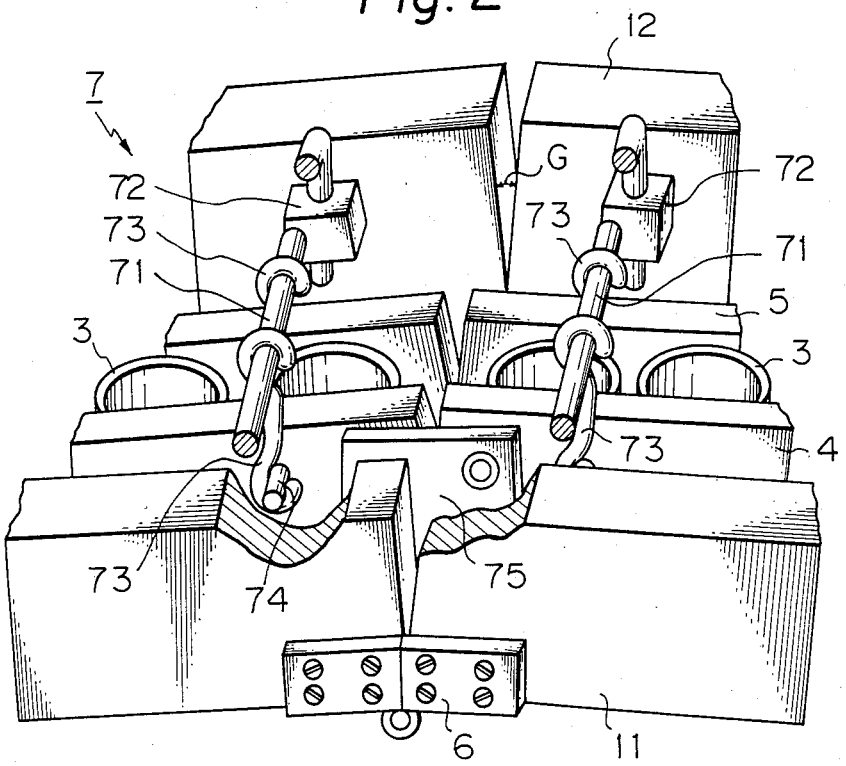
FIG. 2 is a perspective view, partly cut out for easier understanding, of the holding structure of resonator tubes in accordance with the present invention.
Figure 3:
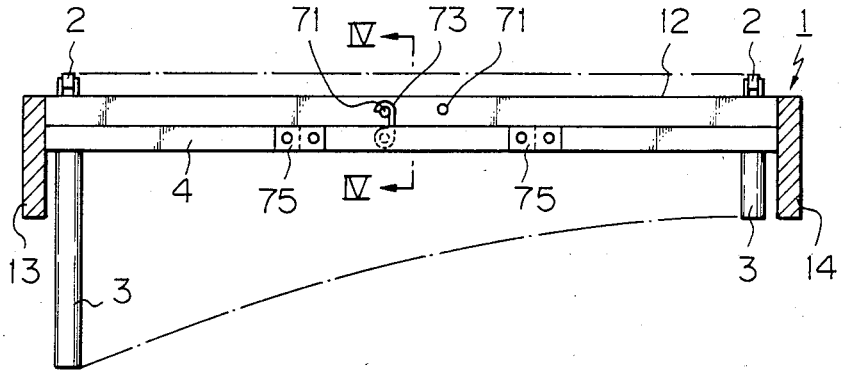
FIG. 3 is a front view, partly in section, of the holding structure.

For easy transportation, the front and rear walls 11 and 12 are each divided at their center into two longitudinal sections which are coupled at their mating ends by hinges 6 as best seen in FIG. 2. In order to minimize center flexion of the front and rear walls 11 and 12, the mating ends of their longitudinal sections are somewhat raised. In other wards, the center ends of the longitudinal sections are located higher than their distal ends coupled to the side walls 13 and 14. The extent of this center rise differs depending on the size of the base frame 1.

Figure 5:
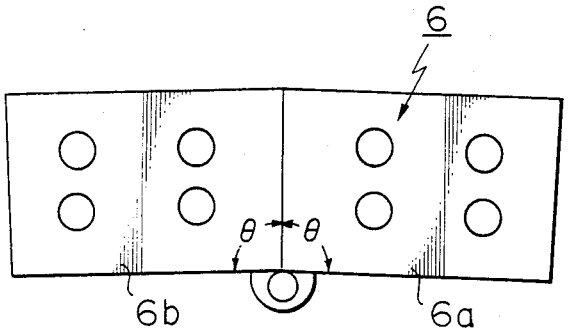
FIG. 5 is a front view of hinges used for the holding structure shown in FIG. 2.

It is usually in a range from 7 to 10 mm. Such a center rise is easily provided by a specified design of the hinge 6. As shown in FIG. 5, each of a pair of hinge pieces **6*a* and 6*b* has a lower corner angle $\theta$ larger than 90 degrees at its mating end. Using such hinges 6, triangular gaps G are left between the mating ends of the longitudinal sections of the front and rear walls 11 and 12**.

Figure 4:
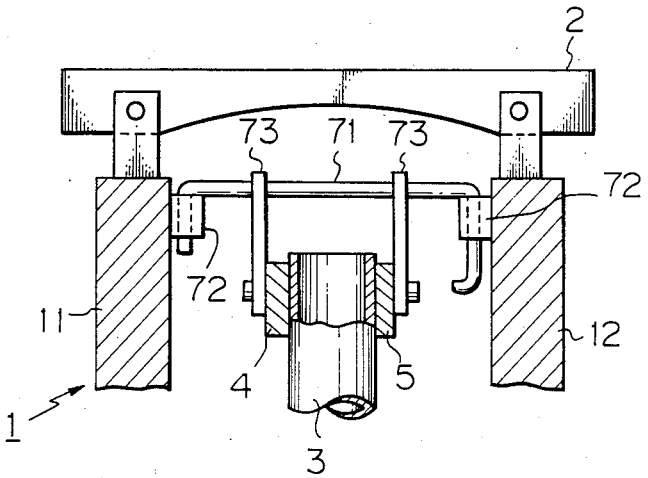
FIG. 4 is a section taken along a line IV—IV in FIG. 3.

The holding structure 7 in accordance with the present invention includes a pair of parallel connecting members 71 in the nature of rods which extend between the front and rear walls 11 and 12 at a level between the sound bars 2 and the resonator tubes 3. Both end sections of each connecting member 71 are bent downwards and received in a seat 72 fixed to the inner face of the associated wall 11 or 12. Preferably at least one end of the connecting member 71 is somewhat bent as shown in FIG. 4 in order to block it against accidental separation.

Each connecting member 71 is accompanied with a pair of hooks 73. Each hook 73 is in hooking engagement at its top end with the associated connecting member and, at its loom end, with a pin 74 fixed to the side face of an associated tube holder 4 or 5.

Figure 6:
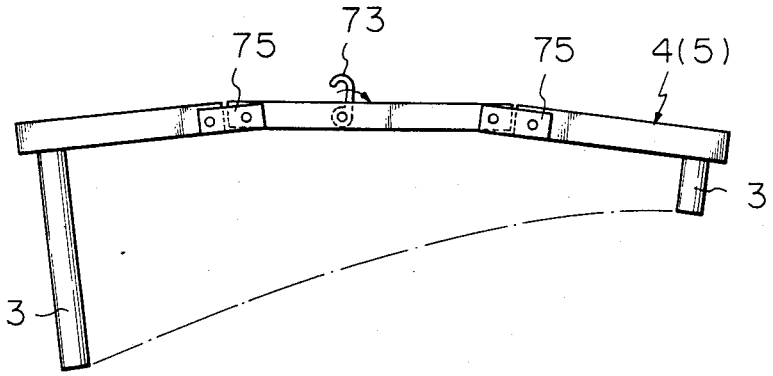
FIG. 6 is a front view of a modified embodiment of the holding structure in accordance with the present invention.

For easy transportation, each tube holder 4 or 5 is preferably divided into several longitudinal sections as shown in FIG. 6 which are pivotally coupled to each other by connectors 75.

Thus, the center sections of the tube holders 4 and 5 are firmly coupled to the center sections of the front and rear walls 11 and 12 of the base frame 1 via the connecting members 71 of the holding structure 7 and, as a consequence, the tube holders 4 and 5 are effectively blocked against center flexion, thereby assuring uniform gaps for all resonator tubes 3.

In a case of a large sound bar type percussive musical instrument, the total weight of the resonator tubes surpasses 20 kg. In such a case, holding only by the above-described holding structure 7 may allow flexion of the tube holders 4 and 5 due to the significant load. In order to avoid this trouble, the level of the connecting rods 71 is preferably chosen so that the tube holders 4 and 5 should also have center rise as in the case of the front and rear walls 11 and 12 of the base frame 1. The level of the connecting members 71 may also be chosen so that the position of the tube holders 4 and 5 should be adjustable in accordance with the center rise of the front and rear walls 11 and 12 of the base frame 1 for further reduced inter-tube variation in gap.

Again in the case of a large size sound bar type percussive musical instrument, the total length of the walls 11 and 12 reaches 3 m, respectively and such a long construction causes significant vibration of the walls 11 and 12 during performance. In the case of the present invention, use of the hooks 73 loads the heavy weight of the resonator tubes 3 to the front and rear walls 11 and 12 and such a load well blocks the walls against such vibration.

As a substitute of the above-described hooking engagement, the connecting member 71 and the tube holder 4 or 5 may be coupled to each other by means of a proper connector secured to them at both ends.

I claim:

1. An improved sound bar type percussive musical instrument comprising a horizontal, substantial rectangular base frame having four walls, a plurality of sound bars mounted side by side to said base frame, tube holders each coupled at both ends to side walls of said base frame, a plurality of resonator tubes held by said tube holders, each being arranged below associated one of said resonator tubes, and means for firmly coupling the center sections of said tube holders to the center sections of front and rear walls of said base frame, said means including a pair of connecting members coupled at both ends to said front and rear walls of said base frame for supporting said tube holders and being arranged so that said tube holders have a center rise.

2. An improved sound bar type percussive musical instrument comprising a horizontal, substantially rectangular base frame having four walls, a plurality of sound bars mounted side by side to said base frame, tube holders each coupled at both ends to side walls of said base frame, a plurality of resonator tubes held by said tube holders, each being arranged below associated one of said resonator tubes, and means for firmly coupling the center sections of said tube holders to the center sections of front and rear walls of said base frame, said means including connecting members coupled at both ends to said front and rear walls of said base frame and a connector coupling each of said connecting members to said tube holders.

3. An improved sound bar type percussive musical instrument as claimed in claim 2 in which the level of each said connecting member is arranged so that the tube holders have a center rise.

4. An improved sound bar type percussive musical instrument as claimed in claim 2 in which said connector comprises a hook in hooking engagement at its top end with a corresponding one of said connecting members and at its bottom end with a pin fixed to the side face of said tube holder.

* * * * *